US006681550B1

(12) United States Patent
Aylward

(10) Patent No.: US 6,681,550 B1
(45) Date of Patent: Jan. 27, 2004

(54) APPARATUS AND METHODS FOR FILLING CONTAINERS WITH PILLS

(75) Inventor: John Thomas Aylward, New Bern, NC (US)

(73) Assignee: Aylward Enterprises, Inc., New Bern, NC (US)

( * ) Notice: Subject to any disclaimer, the term of this patent is extended or adjusted under 35 U.S.C. 154(b) by 22 days.

(21) Appl. No.: 10/218,160

(22) Filed: Aug. 13, 2002

(51) Int. Cl.[7] ..... B65B 1/10

(52) U.S. Cl. ..... 53/473; 53/495; 53/501; 53/244; 53/250

(58) Field of Search ..... 53/501, 508, 250, 53/244, 202, 248, 900, 473, 495, 167, 502, 251; 221/266, 131, 278, 277, 7, 9, 81, 171–173

(56) References Cited

U.S. PATENT DOCUMENTS

| | | | |
|---|---|---|---|
| 422,364 | A | 3/1890 | Bateson |
| 792,918 | A | 6/1905 | Ohlendorf et al. |
| 1,383,623 | A | 7/1921 | Groves |
| 1,824,432 | A | 9/1931 | Hendry |
| 1,839,327 | A | 1/1932 | Mayo |

FOREIGN PATENT DOCUMENTS

| | | |
|---|---|---|
| AU | 20588/34 | 12/1934 |
| CA | 2203856 | 10/1998 |
| WO | WO 94/15859 | 7/1994 |

(List continued on next page.)

*Primary Examiner*—Rinaldi I. Rada
*Assistant Examiner*—Hemant M Desai
(74) *Attorney, Agent, or Firm*—Alston & Bird LLP

(57) ABSTRACT

There is provided an automated packaging apparatus for depositing a predetermined number of pills into a series of containers. The packaging apparatus includes a plurality of independently rotatable rotary slats. Each rotary slat includes an outer peripheral edge portion and the rotary slats are configured so that the outer peripheral edge portions define a common interior space. Each outer peripheral edge portion also defines an inner surface and a plurality of pill apertures. The pill apertures are configured to receive one of the pills from the common interior space at a first position and transmit the pill outside the rotary slats at a second position. A conveyor is configured to move a plurality of open containers along a predetermined path of travel and position each of the containers adjacent a respective rotary slat to define a delivery path that extends between the second position of the rotary slat and the container. At least one drive motor is in driving engagement for rotating the rotary slats. A controller is connected to the drive motor for controlling the drive motor such that the rotary slats can be rotated for different durations.

29 Claims, 7 Drawing Sheets

U.S. PATENT DOCUMENTS

| | | | | |
|---|---|---|---|---|
| 2,094,460 | A | | 9/1937 | McBean et al. |
| 2,479,667 | A | | 8/1949 | Boylan |
| 2,585,558 | A | | 2/1952 | Lakso |
| 2,845,759 | A | | 8/1958 | Cote et al. |
| 3,028,713 | A | | 4/1962 | Kennedy et al. |
| 3,139,713 | A | | 7/1964 | Merrill et al. |
| 3,206,062 | A | | 9/1965 | Rappaport |
| 3,225,513 | A | | 12/1965 | Ehe |
| 3,354,607 | A | | 11/1967 | Lakso |
| 3,387,695 | A | | 6/1968 | Hendrickson |
| 3,417,542 | A | | 12/1968 | Merrill et al. |
| 3,677,437 | A | | 7/1972 | Haigler |
| 3,722,740 | A | | 3/1973 | List |
| 3,782,590 | A | | 1/1974 | Apfel |
| 3,837,139 | A | | 9/1974 | Roseberg |
| 3,925,960 | A | | 12/1975 | Saari et al. |
| 3,979,878 | A | | 9/1976 | Berney |
| 3,986,636 | A | | 10/1976 | Hoppmann et al. |
| 4,017,003 | A | | 4/1977 | Heino |
| 4,047,637 | A | | 9/1977 | Grunstad et al. |
| 4,094,129 | A | | 6/1978 | List |
| 4,094,439 | A | | 6/1978 | List |
| 4,265,072 | A | | 5/1981 | Egli |
| 4,674,259 | A | | 6/1987 | Hills |
| 4,677,283 | A | | 6/1987 | Lewis |
| 5,463,839 | A | | 11/1995 | Stange et al. |
| 5,515,668 | A | | 5/1996 | Hunt et al. |
| 5,638,657 | A | | 6/1997 | Archer et al. |
| 6,185,901 | B1 | | 2/2001 | Aylward |
| 6,266,946 | B1 | | 7/2001 | Aylward |
| 6,269,612 | B1 | | 8/2001 | Aylward |
| 6,401,429 | B2 | * | 6/2002 | Aylward ..... 53/244 |
| 6,422,418 | B1 | * | 7/2002 | Collins et al. ..... 221/253 |
| 6,505,460 | B2 | * | 1/2003 | Aylward ..... 53/473 |
| 6,561,377 | B1 | * | 5/2003 | Pearson et al. ..... 221/7 |

* cited by examiner

APPARATUS AND METHODS FOR FILLING CONTAINERS WITH PILLS

BACKGROUND OF THE INVENTION

1) Field of the Invention

The present invention relates to packaging machines, and more particularly relates to automated packaging machines for filling containers with pills and associated methods.

2) Description of Related Art

Pharmaceutical medicines and associated packaging apparatus are typically subject to relatively strict consumer protection guidelines. For example, pills, capsules, and the like, must be produced and packaged in such a way as to at least meet the minimum sterility requirements mandated by federal regulations. In addition, the pills should be delivered into the packaging such that the contents accurately meet the claimed labeling "count", i.e., each package includes exactly the predetermined number of pills. Notwithstanding the above, it is also desired to package the product in a mass production operation to offset costs typically attributed to a labor intensive operation in order to provide an economic product.

In the past, pill filling machines have been proposed that provide automated bottle counts by filling a hopper with pills and causing a plurality of the pills to be caught by a pill capturing device, such as an array of rotary slats. The rotary slats drop the captured pills into a plurality of bottles disposed in alignment with the dropping pills. The bottles are distributed along an endless conveyor belt that is timed to advance and stop the bottles according to the filling operation.

Conventional pill capturing devices more particularly include a series of rotary slats each configured to receive, hold, and move a plurality of capsules or pills along a closed path. The rotary slats are typically discs fixed on a rotatable shaft and have a plurality of openings in the outer peripheral edge portion thereof for capturing individual pills. Accordingly, the closed path is arcuate and generally disposed between a pill hopper and discharge area above the conveyor belt. By the rotary action of the slat, the pills move in a direction normal to the conveyor belt. The pill capturing device then generally discharges the pills by rotating the slats, which move corresponding to the closed path, such that the pills fall out of the respective openings at the filling station. The pills are often funneled through a chute that empties into a corresponding bottle.

The "count," or number of pills in the bottle, is determined by positioning the bottles in the pill dropping zone for a predetermined time. The duration of the filling operation for each bottle corresponds to the number of openings in each slat that the machine is capable of delivering to the bottles per unit of time. The duration of the filling operation, speed of the rotary slats, and configuration of the pill capturing device are used to calculate the count.

Unfortunately, if the pill capturing device fails to capture a pill in each and every cavity or receptacle, or if a pill should mistakenly be diverted, at least one of the bottles can be improperly filled. The conventional solution to this problem is to situate an operator adjacent to the slats to ensure that each receptacle is filled with a pill. If a pill is missing, the operator manually places a pill in the receptacle. Such an approach involves labor costs and can be unsatisfactory for sterility purposes. In addition, the accuracy of the count of each bottle is largely determined by the operator and, as such, a fully and consistently accurate count cannot be guaranteed.

U.S. Pat. No. 6,185,901 to Aylward, which is incorporated herein by reference, provides an exemplary solution to this problem by way of a machine with independently driven rotary slats. The pills are allowed to fall into an exterior receptacle of a rotary slat and, in one embodiment, passed under a rotary brush in an attempt to prevent two pills from being disposed in the same receptacle. A separate counting device is associated with each rotary slat for counting each pill as it falls from the slat into the container. A positive count is provided for each container and improperly filled slats will not affect the total count for that container. If a particular container has a low count, the respective slat can be further rotated to fill the container. Because the slats are independently driven, the other slats can remain stationary to prevent overfilling. Thus, the machine permits an accurate filling of each bottle.

One alternative apparatus is a rotatable drum, as provided in U.S. Pat. No. 4,094,439 to List. The rotatable drum includes a plurality of parallel rows of throughgoing holes that constitute receptacles for dragees. The dragees enter the receptacles in the drum from the interior of the drum at an inner input location, exit to the exterior of the drum at an outer retrieval location, and are filled into bottles. An ordering device facilitates the entry of the dragees into the receptacles, and feeler blades engage the receptacles. If any of the receptacles in an axially extending row do not contain a dragee, one of the feeler blades actuates a bolt pusher, which prevents any of the dragees in the row from being filled into the bottles. Instead, a solenoid and knockout bar empty the receptacles of the row. By preventing the bottles to be filled from partially filled rows of receptacles, the apparatus prevents the different bottles from being filled at different rates.

Undesirably, the additional mechanical components that are required for emptying the partially filled rows of apertures increase the complexity, cost, and likelihood of failure of the apparatus. Additionally, emptying the partially filled rows slows the process of filling the bottles because no pills are dispensed from those rows.

Accordingly, there is a great need for a packaging apparatus which provides an accurate count for each container and operates at a high speed. The apparatus should require a minimum of operator intervention. Additionally, the apparatus should be cost effective, both in initial cost and maintenance costs.

BRIEF SUMMARY OF THE INVENTION

The present invention provides an automated packaging apparatus for depositing a predetermined number of pills into a series of containers. The pills are first disposed into the interior of a plurality of rotary slats of the packaging apparatus. Each slat receives the pills into pill apertures at a peripheral edge portion of the slat, rotates, and dispenses the pills through the pill apertures. Each slat is rotated independent of the other slats, and a detector and controller determine when the corresponding container has been filled. Thus, even if some pill apertures in some rotary slats do not receive or dispense pills, each rotary slat still provides an accurate count. In addition, by using a common interior space of a plurality of slats, no brush or other complex machinery is required.

The packaging apparatus includes a plurality of independently rotatable rotary slats. The rotary slats, which are formed of a polymer, are supported by a plurality of cradle rollers and positioned with small gaps between adjacent slats. Thus, the rotary slats are configured so that their outer peripheral edge portions define a common interior space. Each of the outer peripheral edge portions of the rotary slats defines an inner surface and a plurality of pill apertures. The pill apertures are configured to receive a pill from the common interior space at a first position and transmit the pill outside the rotary slats at a second position. In one embodiment, an inner contour of each of the rotary slats slopes toward the pill apertures to facilitate the entry of pills into the pill apertures. In another embodiment, the inner contour may also vary around the circumference of the rotary slat to facilitate the entry of pills into the pill apertures.

A shroud, which may be adjusted, extends from a location proximate to the first position to a location proximate to the second position such that the shroud prevents the pills from exiting the rotary slats through the pill apertures prior to the pills reaching the second position. A first air blower is located in the common interior space and configured to emit air towards the pill apertures at the second position. The pills may also be urged from the pill apertures by a plow that extends from within the rotary slats toward the pill apertures. The pills may fall from the pill apertures at the second position by virtue of the pill apertures being slanted downward toward the outside of the rotary slats when positioned at the second position.

A conveyor is configured to move open containers along a predetermined path of travel and position each of the containers adjacent a respective rotary slat to define a delivery path that extends between the second position and the container. Chutes define the delivery paths that extend from the second position of each rotary slat to the corresponding container. A delivery sensor detects the delivery of a pill through the delivery path. A second air blower is located outside of the rotary slats and is configured to emit air towards the pill apertures at a third position such that any jammed pills positioned within the pill apertures at the third position are urged back into the common interior space. A sensor detects the quantity of the pills in the common interior space, and a reservoir gate controls the passage of pills from a reservoir, which holds the pills and feeds them into the common interior space.

Each of the rotary slats is independently rotatable, and a drive motor is in driving engagement with each of the rotary slats. Drive wheels, which are engaged with the rotary slats for independently rotating them, have outer surfaces that are contoured to match the outer peripheral edge portions of the rotary slats. A controller is connected to and controls the drive motors such that the rotary slats can be rotated for different durations. In one embodiment, the controller alternately accelerates and decelerates the rotary slats to vibrate them and agitate the pills.

Additionally, the present invention provides a method of depositing pills into containers. The pills are first disposed in a common interior space defined by a drum made up of several rotary slats. The pills are captured in pill apertures defined by the outer peripheral edge of the rotary slats. The rotary slats are accelerated and decelerated to agitate the pills and urge them into the pill apertures. Each of the rotary slats is independently rotated so that the pill apertures are moved to a position at which the pills are released from the apertures and delivered to containers. Air is directed toward the pills to facilitate their release from the apertures. If a pill fails to release from a pill aperture, air is directed toward the pill to urge the pill back into the interior of the drum. The released pills are directed toward chutes that delivery the pills toward the containers. As the pills are delivered, they are counted and the number of pills delivered to each container is calculated. When one of the containers receives a predetermined number of pills, the rotary slat corresponding to that container is stopped. The rotation of the other rotary slats is continued until each corresponding container has received the predetermined number of pills. The number of pills in the interior of the drum is also detected and additional pills are automatically fed into the interior as necessary.

Thus, the packaging apparatus of the present invention provides an accurate count for pills dispensed to each container. The apparatus requires a minimum of operator intervention, and it can operate at a high rate of speed. Additionally, the apparatus provided is cost effective, both in initial cost and maintenance cost.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

Figure 1:
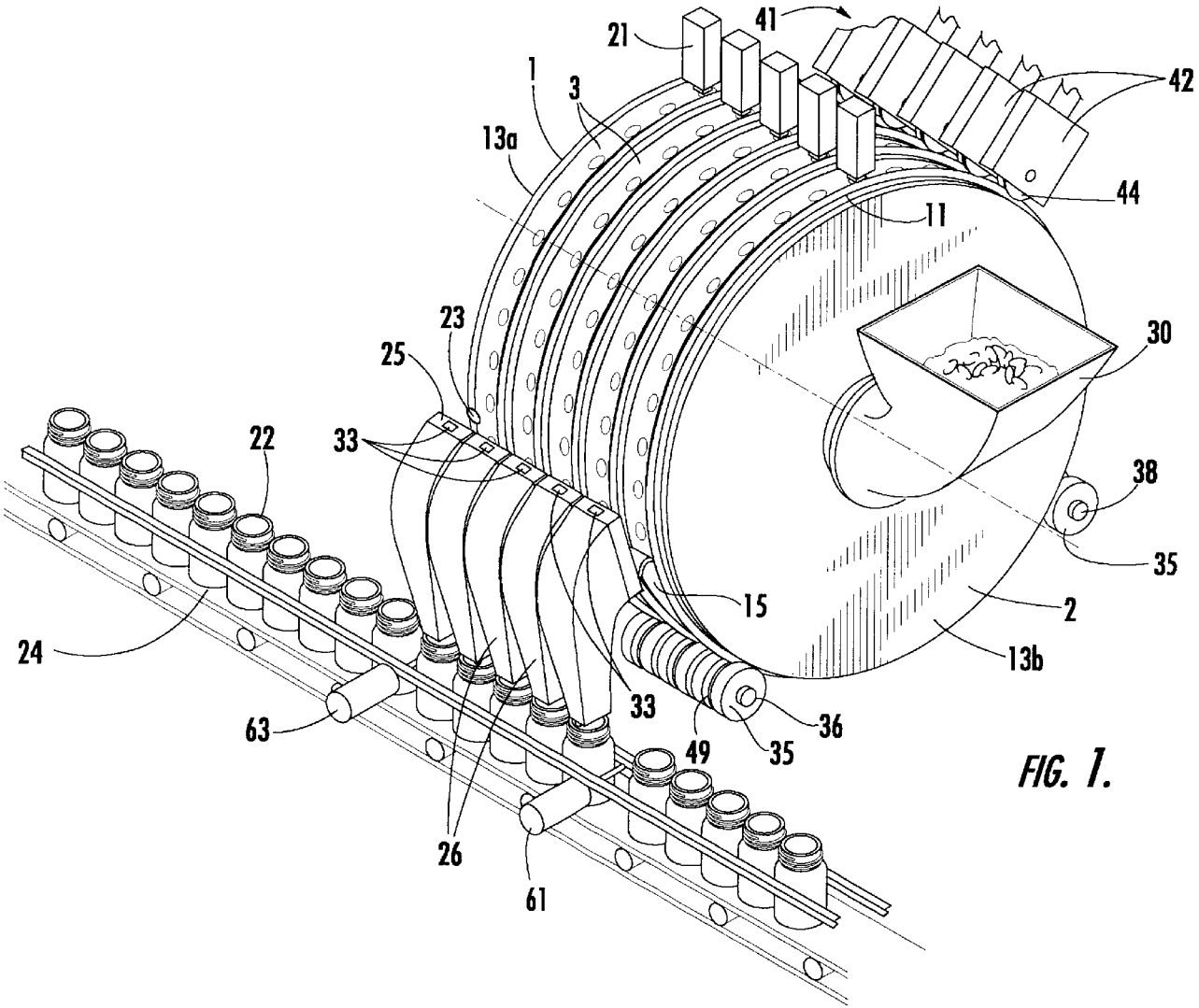
FIG. 1 is a perspective view of a packaging apparatus according to the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Generally described, the present invention is directed to an automated packaging apparatus 1, which delivers pills 23 from a drum 2 into containers 22. The term "pill" is used herein throughout, but the term is not intended to be limiting and includes any discrete articles of the type used in the pharmaceutical industry or otherwise including, but not limited to, capsules, caplets, gelcaps, dragees, and tablets. Similarly, the receiving container 22, although illustrated as a bottle throughout, is not limited thereto and can be any one of a number of configurations which provides an opening for receiving discrete articles therein, such as pouches or boxes.

Figure 3:
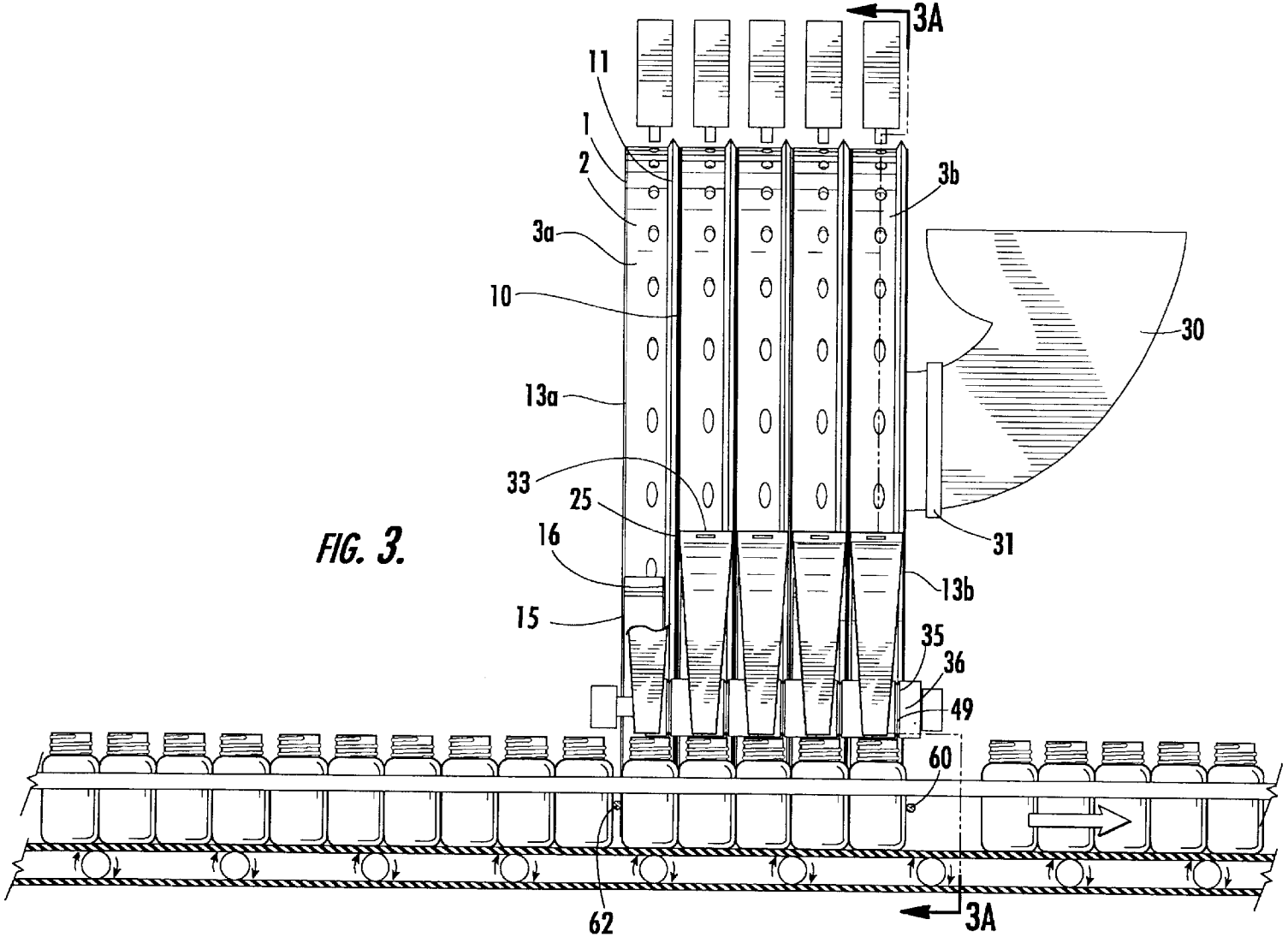
FIG. 3 is an elevation view of the packaging apparatus according to the present invention shown with one chute partially cut away for illustrative clarity.
Figure 3A:
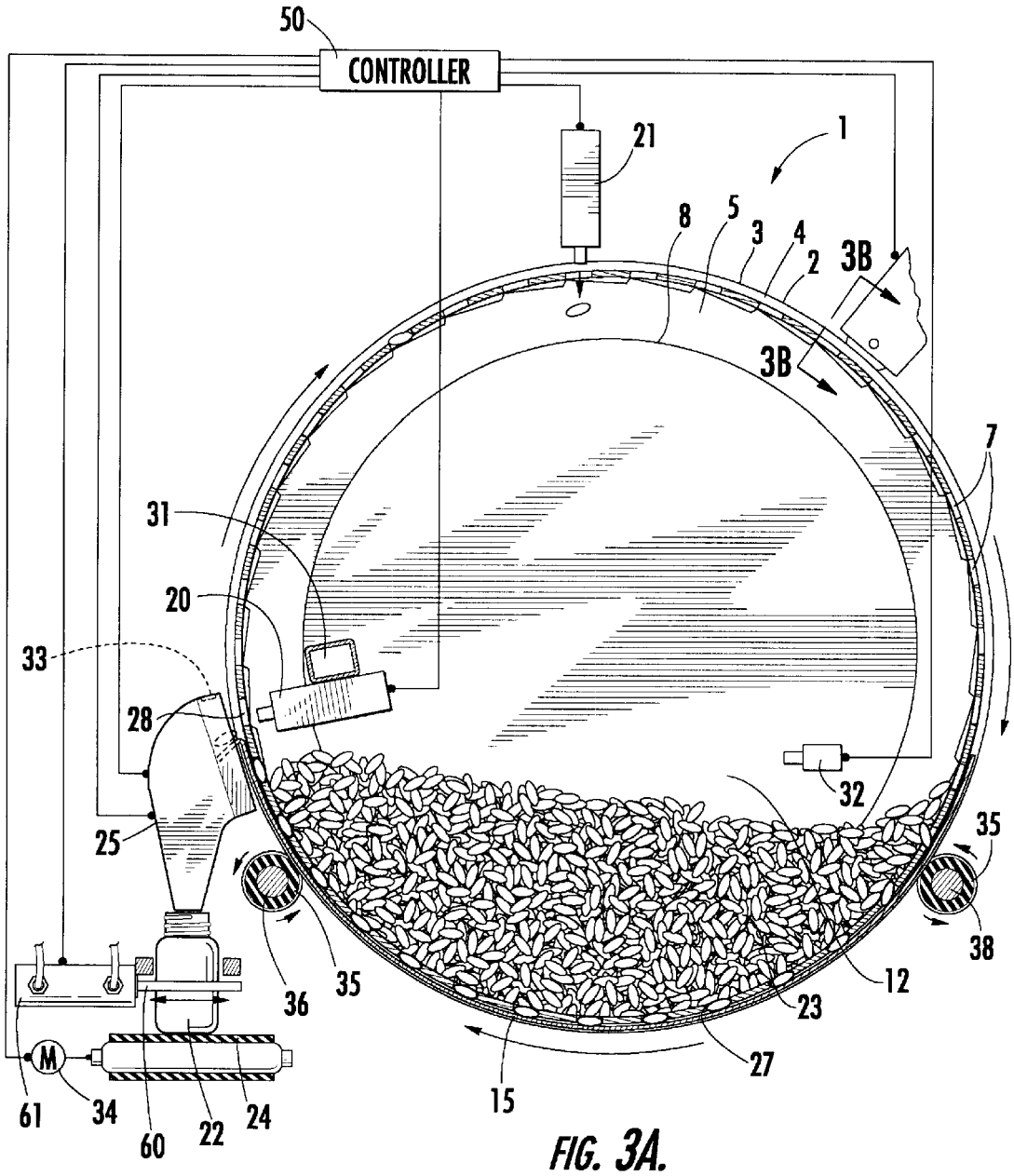
FIG. 3A is a section view of the packaging apparatus of FIG. 3 as seen from line 3A—3A.

As shown in FIG. 1, the packaging apparatus 1 includes a plurality of rotary slats 3 and end plates 13*a*, 13*b* which together comprise the drum 2, a shroud 15 that surrounds part of the drum 2, a drive assembly 41, first and second cradle rollers 36, 38, a plurality of chutes 25 with delivery sensors 33, and a conveyor 24. The drive assembly 41 comprises a plurality of drive devices 42, each of which includes a motor in driving engagement with a drive wheel 44. As shown in FIG. 3A, the packaging apparatus 1 also includes a level sensor 32 and first and second air blowers 20, 21. A filling station 26 is defined by a respective rotary slat 3, chute 25, delivery sensor 33, and an aligned container 22. As such, the apparatus includes a plurality of filling stations 26 corresponding to the number of rotary slats 3.

Figure 2:
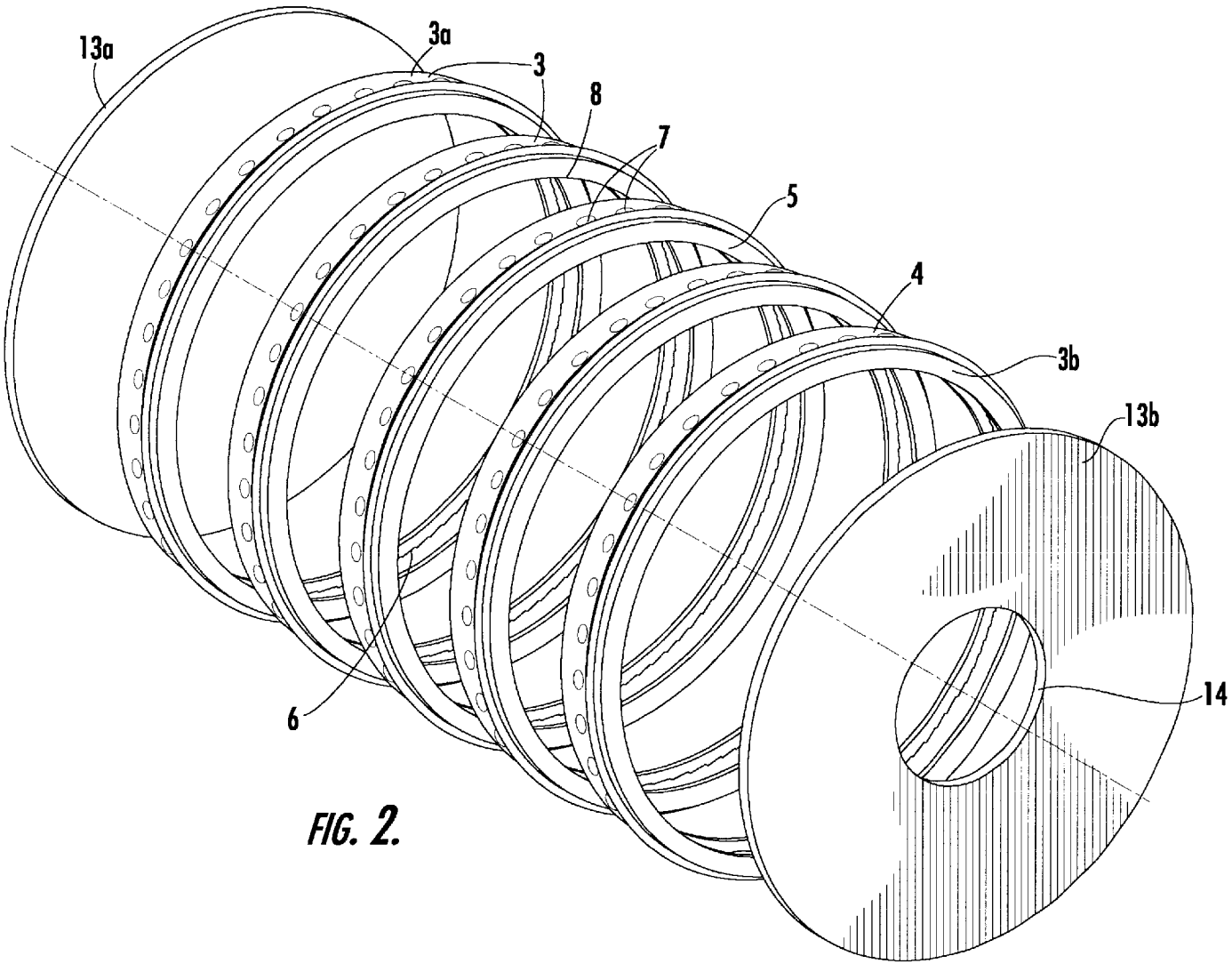
FIG. 2 is an exploded view of the rotary slats of the drum of the packaging apparatus.

As shown in FIGS. 2 and 3A, each rotary slat 3 defines an outer peripheral edge portion 4 and sidewalls 5. The outer peripheral edge portion 4 of each rotary slat 3 defines a plurality of pill apertures 7 through which a pill 23 can pass. The sidewalls 5 define slat connection apertures 8 such that when the rotary slats 3 are positioned adjacent one another, the slat connection apertures 8 of adjacent rotary slats 3 correspond to one another and the rotary slats 3 together define a common interior space 12 of the drum 2. In the figures, the first and second end plates 13*a*, 13*b* are positioned proximate to the first and last rotary slats 3*a*, 3*b*, respectively, so as to further define the common interior space 12. The first end plate 13*a* is a closed, circular plate. The second end plate 13*b* defines a drum fill apparatus 14 through which pills 23 are fed into the drum 2. In another embodiment, the end plates 13*a*, 13*b* are not separate components but are instead integral to the rotary slats 3 so that each of the first and last rotary slats 3*a*, 3*b* of the packaging apparatus 1 define a slat connection aperture 8 in only one sidewall 5. The opposite sidewall 5 of each of the first and last rotary slats 3*a*, 3*b* comprises the end plates 13*a*, 13*b* respectively and may define a drum fill aperture 14 or may be closed with no aperture.

A variety of materials can be used for the construction of the rotary slats 3 including, but not limited to, metals, metal alloys, and polymers. Preferably, the rotary slats 3 are formed of a durable, low friction material that is cost effective for manufacture. A preferred material is a compound comprising acrylonitrile-butadiene-sytrene and polytetrafluoroethylene. Depending on the type of pills 23 that are to be used with the rotary slats 3, it may also be important that the material of the rotary slats 3 does not chemically affect the pills 23. The other components of the packaging apparatus 1 can be made of the same or different materials. Another suitable material, which is preferable for the chutes 25, is acetal or Delrin® polymer, available from DuPont.

The rotary slats 3 of the drum 2 are held between the cradle rollers 36, 38 and the drive wheels 44 of the drive assembly 41 with a small interslat gap 10 between adjacent rotary slats 3. In one embodiment, each of the rotary slats 3 defines a double beveled alignment guide 11 on the outer peripheral edge portion 4 of the rotary slat 3. The cradle rollers 36, 38 comprise cradle roller wheels 35 that define V-shaped slots 49 that correspond to the shape of the alignment guides 11 of the rotary slats 3. Similarly, the drive wheels 44 of the drive assembly 41 also correspond to the shape of the alignment guides 11 of the rotary slats 3. Thus, the engagement of the rotary slats 3 with the rollers 36, 38, 42 maintains the position of the rotary slats 3 and the interslat gaps 10 between the rotary slats 3. The interslat gaps 10 are preferably smaller than the smallest dimension of the pills 23 so that the pills 23 cannot pass through the interslat gaps 10. For example, the interslat gap 10 can be between about 0.5 and 1 millimeter. Further, each of the cradle roller wheels 35 and the drive wheels 44 are independently rotatable. Thus, each rotary slat 3 is rotatable separate from the other rotary slats 3.

As shown in FIG. 2, each of the rotary slats 3 and the end plates 13*a*, 13*b* are individually removable from and assembleable on the cradle rollers 36, 38. Preferably, one or more of the cradle rollers 36, 38 and the drive assembly 41 are at least partially removable to facilitate disassembly of the rotary slats 3, which are secured between the cradle rollers 36, 38 and the drive wheels 44 of the drive assembly 41. For example, each of the drive devices 42 of the drive assembly 41 is supported by an air cylinder 51. The air cylinders 51 hold the drive devices 42 against the rotary slats 3 so that the rotary slats 3 are held in alignment and so that the drive wheels 44 engage the rotary slats 3 without slipping. The force exerted by the air cylinders 51 can be adjusted to optimize the engagement of the drive wheels 44 with the rotary slats 3 during operation. Additionally, the air cylinders 51 can retract the drive devices 42 so that the rotary slats 3 can be removed or serviced. The assembly and disassembly flexibility provided by the invention is such that the packaging apparatus 1 can accommodate different numbers of filling stations 26 (such as the five illustrated in FIG. 1) by increasing or decreasing the number of rotary slats 3. Additionally, if one of the components malfunctions, the other filling stations 26 remain operable and, advantageously, modular repair or replacement of only the problematic rotary slat 3 or end plate 13*a*, 13*b* can improve repair costs and decrease machine downtime. Further, the rotary slats 3 can be replaced with other rotary slats 3 that are configured to dispense pills 23 with specific characteristics. Thus, by changing the rotary slats 3, the packaging apparatus 1 can be used to dispense pills 23 of varying size, shape, weight, and composition.

Figure 3B:
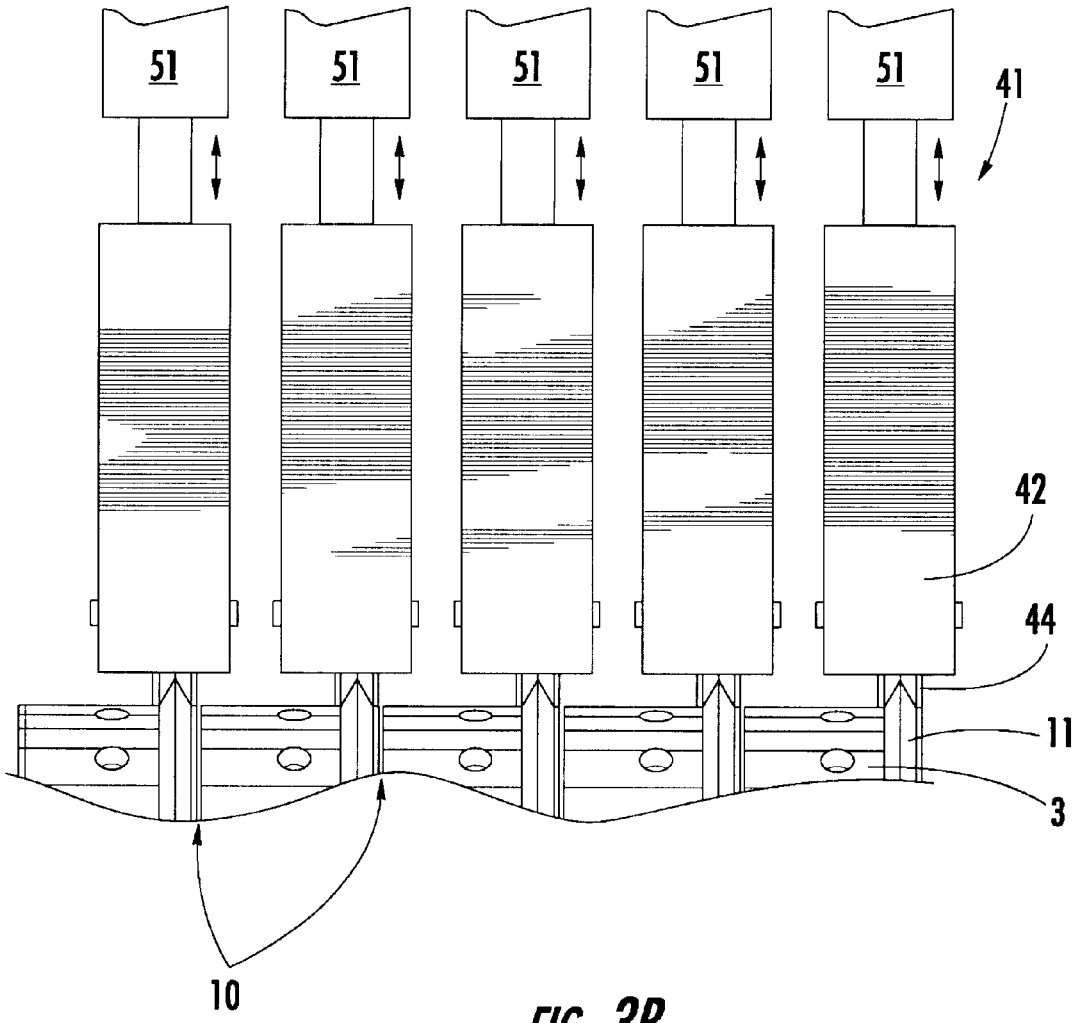
FIG. 3B is a section view of the packaging apparatus of FIG. 3 as seen from line 3B—3B of FIG. 3A.

Each rotary slat 3 is operably connected with the drive assembly 41 so that it can be operated individually, or separately from, the other rotary slats 3. One possible drive assembly 41 is illustrated in FIG. 3B. The drive assembly 41 includes the drive devices 42, which are located at consecutively spaced positions that correspond to the positions of the rotary slats 3 so that each of the drive wheels 44 is rotatably connected to a respective rotary slat 3. In the embodiment shown in FIG. 3B, the drive wheels 44 are shaped to correspond to the alignment guides 11 of the rotary slats 3. The alignment guides 11 keep the rotary slats 3 in proper alignment with the drive wheels 44 and separated from each other so as to maintain the interslat gaps 10. The drive wheels 44 are formed of an elastomeric traction material such as hard rubber. Because each of the drive wheels 44 is rotatable independently of the other drive wheels 44, each drive wheel 44 can be rotated at a different speed than the other drive wheels 44. Thus the rotary slats 3 can be operated at varying speeds, independent of the other rotary slats 3. Each drive device 42 further comprises a drive motor (not shown) in driving engagement with the drive wheel 44 via a drive transfer mechanism (not shown). Each drive transfer mechanism comprises a drive shaft or other conventional power transmission components such as gears, belts, and pulleys. Accordingly, rotation of each drive motor causes the respective rotary slat 3 to rotate. An alternative drive assembly 41 comprising frustoconical drive wheels for rotating rotary slats 3 is further described in U.S. Pat. No. 6,185,901, which is herein incorporated by reference and could be used to drive the drive wheels 44 acting on a groove (not shown) or the alignment guides 11 of the rotary slats 3. Alternatively, the drive assembly 41 may comprise other components for engaging the rotary slats 3. For example, the drive assembly 41 may comprise drive wheels 44 that engage other arrangements of flat or bevel gears and/or belts that are connected to the drive motors.

As each of the rotary slats 3 rotates, the pill apertures 7 move in a path defined by the outer peripheral edge portion 4 of the rotary slat 3, passing through a first position 27 and a second position 28, as shown in FIG. 3A. Pills 23 contained in the common interior space 12 of the drum 2 are rotated and tumbled near the first position 27 of the pill apertures 7. Pills 23 fall into, and become seated in, the pill apertures 7. Once a pill 23 is seated in a pill aperture 7, the shroud 15 prevents the pill 23 from falling through the pill aperture 7. Instead, the pill 23 is held seated in the pill aperture 7 as the pill aperture 7 approaches the second position 28. The second position 28 preferably occurs at or before a position where the tangential direction of the outer peripheral edge portion 4 of the rotary slat 3 at the pill aperture 7 is vertical. Because the shroud 15 extends to, but not beyond, the second position 28, a pill 23 seated in a pill aperture 7 that reaches the second position 28 is no longer retained within the rotary slat 3 by the shroud 15. Thus, the pill 23 falls out of the pill aperture 7 toward one of the chutes 25, which directs the pill 23 into the container 22 that corresponds to the filling station 26. A first air blower 20, supported by a beam 31 extending longitudinally in the drum 2, is configured to blow air toward the pill aperture 7 at the second position 28 in a direction toward the outside of the drum 2. The first air blower 20 facilitates the ejection of the pills 23 from the pill apertures 7 in a direction toward the corresponding chute 35. A second air blower 21 is configured to blow air toward the pill apertures 7 in a direction toward the inside of the drum 2. The second air blower 21 is located so that it blows air at the apertures 7 after the apertures have passed through the second position 28 and before they have reached the first position 27. If a pill 23 becomes seated in one of the pill apertures 7 and is not ejected from the pill aperture 7 at the second position 28, the second air blower 21 will exert a force upon the pill 23 so that the pill 23 falls back into the drum 2. Thus, the pills 23 preferably enter the pill apertures 7 where the tangential direction of the rotary slats 3 is horizontal at the first position 27 and exit the pill apertures 7 where the tangential direction of the rotary slats 3 is vertical at the second position 28.

The shroud 15 that is shown in the figures extends around approximately half the circumference of the outer peripheral edge portion 4. The shroud 15 also defines a plurality of shroud cut-outs 16 that correspond to the positions of the alignment guides 11 and the cradle roller wheels 35 of the first and second cradle rollers 36, 38. The alignment guides 11 of the rotary slats 3 extend through the shroud cut-outs 16 to contact the cradle roller wheels 35. Alternatively, the cradle roller wheels 35 can extend through the shroud cut-outs 16 to contact the rotary slats 3. The shroud cut-outs 16, and the cradle roller wheels 25, are located out of the path defined by the pill apertures 7 so that the shroud 15 retains the pills 23 as they pass between the first position 27 and the second position 28 and the pills 23 do not escape through the shroud cut-outs 16. It will be understood that the size and position of the shroud 15 can be varied from that shown in the figures, as may be necessary for optimum efficiency of the packaging apparatus 1 depending on the shape, size, and surface characteristics of the pills 23.

Figure 4:
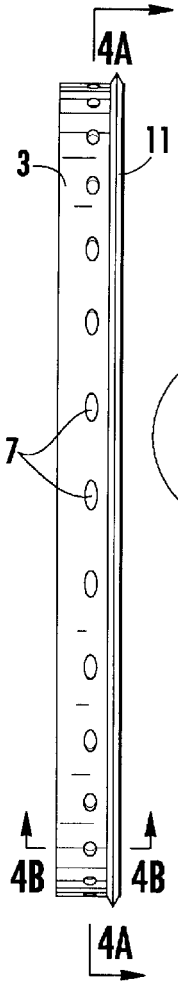
FIG. 4 is an elevation view of the rotary slat of the packaging apparatus of FIG. 3.
Figure 4A:
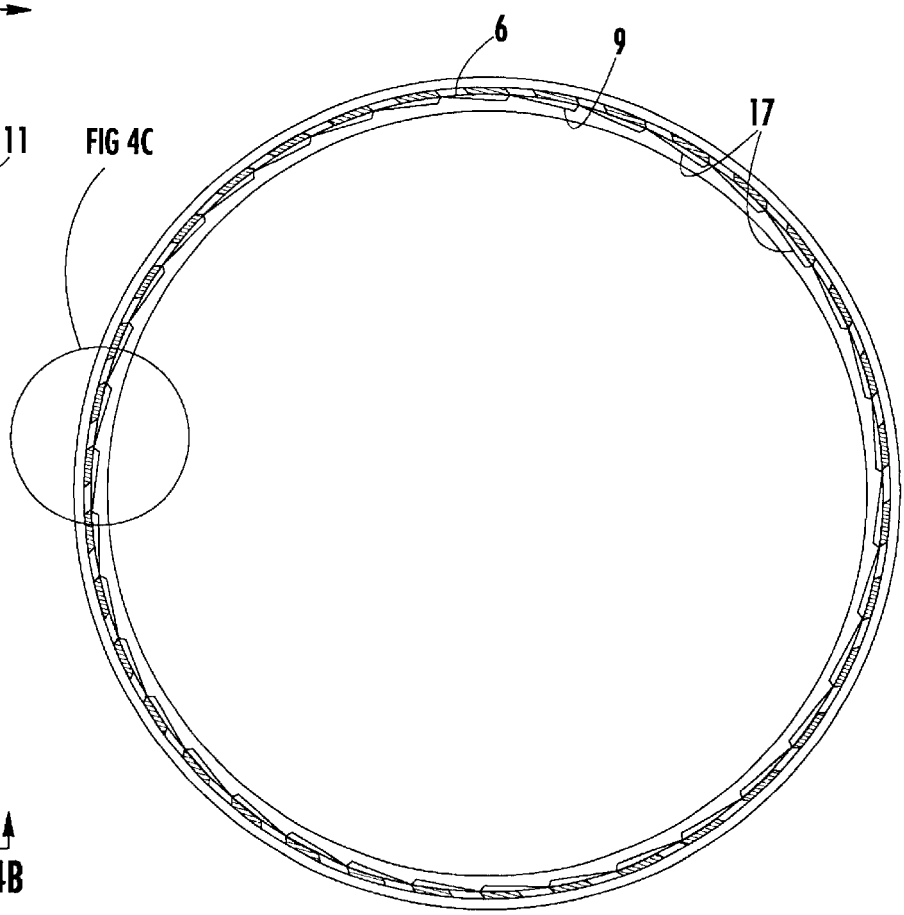
FIG. 4A is a section view of the rotary slat of FIG. 4 as seen from line 4A—4A.
Figure 4B:
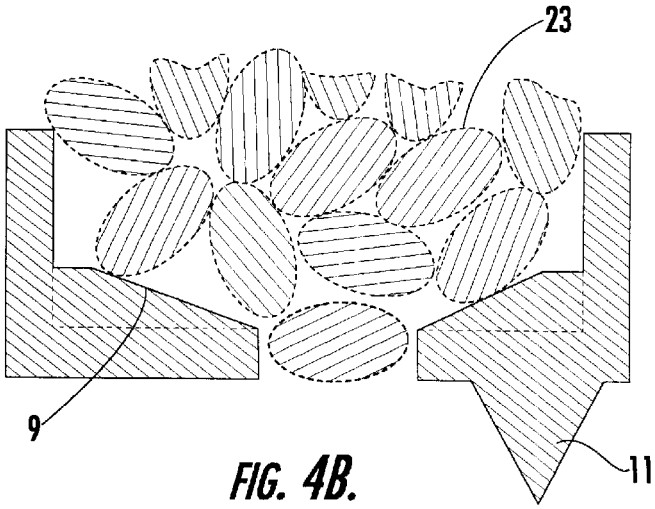
FIG. 4B is a section view of the rotary slat of FIG. 4 as seen from line 4B—4B.

The inner surface 6 of each of the rotary slats 3 may define a variety of shapes or patterns to increase the efficiency of the packaging apparatus 1. For example, a rotary slat 3 according to one embodiment is shown in FIG. 4. A cross-sectional view of the rotary slat 3, shown in FIG. 4A, shows an inner contour 9 defined by the inner surface 6 of the rotary slat. The inner contour 9 of this embodiment, which comprises a plurality of ridges 17, facilitates the lifting of pills 23 as the rotary slat 3 rotates. The inner contour 9 is especially useful when the packaging apparatus 1 is used to package pills 23 that have a smooth or slippery outer surface because the inner contour 9 increases the mixing of the pills 23 and, hence, the likelihood that the pills 23 will become seated in the pill apertures 7. The inner contour 9 may also comprise other ridges, bumps, grooves, channels, knurling, and the like. The inner contour 9 may vary around the circumference of the rotary slat 3, such as the ridges 17 shown in FIG. 4A, or the inner contour 9 may be uniform around the circumference of the rotary slat 3. Also, the inner contour 9 may extend to a location near the pill apertures 7, or the inner contour 9 may intersect the pill apertures 7 so that the pill apertures 7 are disposed in the inner contour 9. For example, as shown in FIG. 4B, the inner contour 9 slopes toward the pill apertures 7 to comprise a groove in the rotary slat 3 that extends at the same depth around the entire circumference of the inner surface 6 of the rotary slat 3. The pill apertures 7 are disposed within the groove of the inner contour 9 and the slope of the inner contour 9 toward the pill apertures 7 facilitates the entry of pills 23 into the pill apertures 7.

Figure 4C:
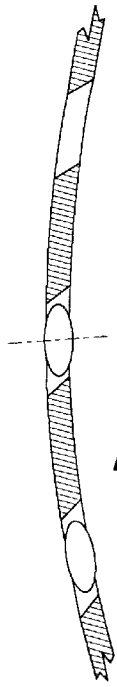
FIG. 4C is an enlarged section view of the pill apertures from the indicated section of FIG. 4A.

The exit of the pills 23 from the pill apertures 7 is facilitated by the shape of the pill apertures 7. In a preferred embodiment, shown in FIG. 4C, the pill apertures 7 are not perpendicular to the tangent of the outer peripheral edge portion 4 of the rotary slats 3. Instead, each pill aperture 7 is slanted downward, toward the outside of the drum 2, when the pill aperture 7 is positioned at the second position 28. Thus, a pill 23 disposed in the pill aperture 7 will tend to fall toward the outside of the drum 2 when the pill aperture 7 reaches the second position 28. The rotary slat 3 shown in FIG. 4A may be used with or without the first air blower 20.

Figure 5A:
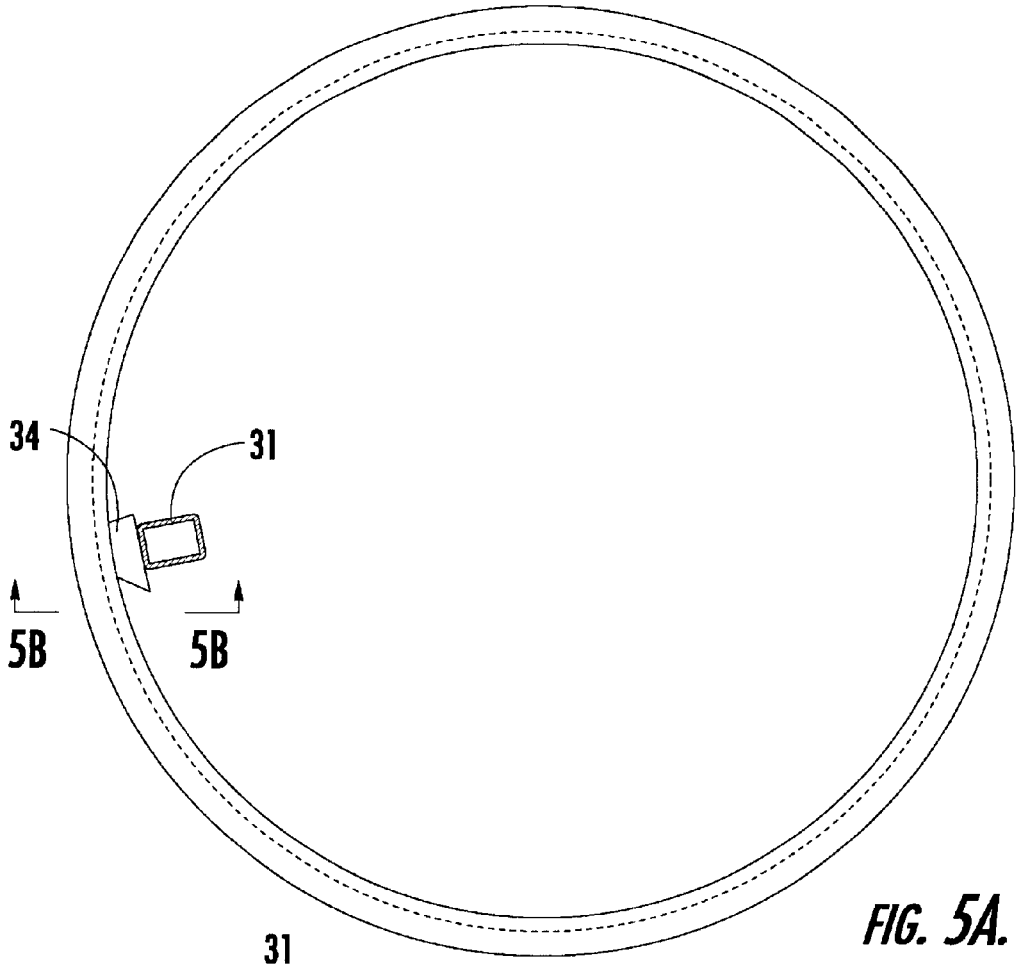
FIG. 5A is an elevation view of a plow with a rotary slat according to another embodiment of the present invention.
Figure 5B:
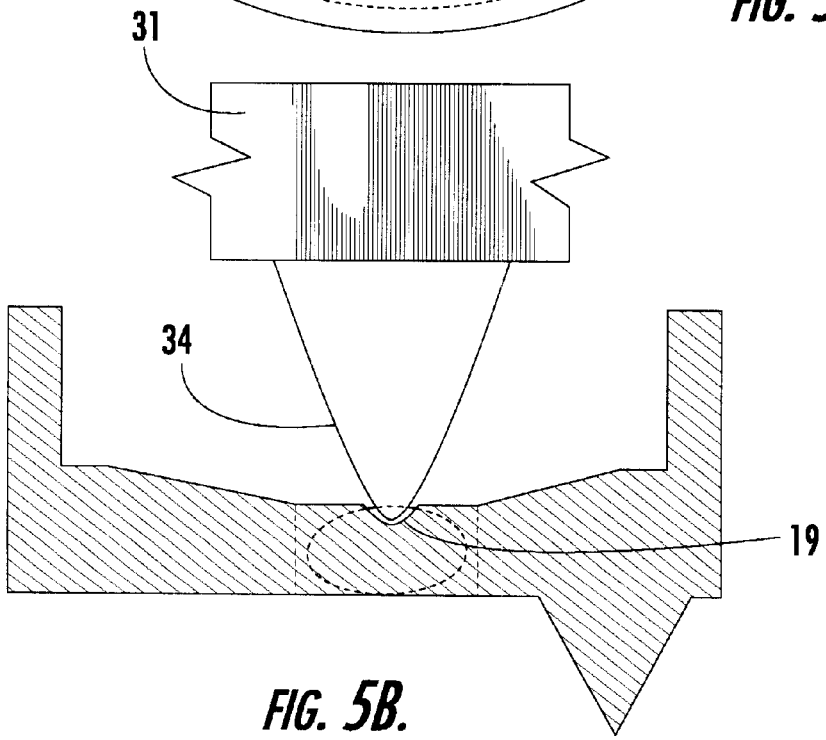
FIG. 5B is a section view of the plow and the rotary slat of FIG. 5A as seen from line 5B—5B.

In an alternate embodiment shown in FIG. 5A, plows 34 urge the pills 23 from the pill apertures 7 at the second position 28. The plows 34 extend from the beam 31 toward the rotary slats 3. Each plow 34 extends into a channel 19 defined by the inner surface 6 of each rotary slat 3, as shown in FIG. 5B. Each plow 34 has a curved surface that contacts the pills 23 and pushes the pills 23 out of the pill apertures 7 and toward the chutes 25. The plows 34 may be used in conjunction with the first air blower 20, but preferably the plows 34 are used instead of the first air blower 20. Similarly, an upper plow (not shown) may substitute for the second air blower 21. Additionally, or alternatively, a vibratory actuator may be mounted on the beam 31 to cause the pills 23 to drop from the apertures 7.

As shown in FIG. 3A, the packaging apparatus 1 includes a delivery sensor 33 associated with each filling station 26. The delivery sensor 33 is positioned near the top of the chute 25 and is configured to detect the passage of each pill 23 into the chute 25 or container 22. The delivery sensor 33 detects the passage of each pill 23 as the pill enters the chute 25 and drops into the corresponding container 22. Alternatively, the delivery sensor 33 may be positioned above, below, or elsewhere within the chute 25. In the embodiment shown in FIG. 3A, the top of each chute 25 is tangential to the drum 2 at the second position 28 of the rotary slats 3, and each chute 25 curves toward the containers 22. Each delivery sensor 33 detects across the tangential top of the respective chute 25. It is appreciated that other embodiments of the chutes 25 are possible including, for example, straight chutes with horizontal or angled tops. Additionally, the chute 25 may not be necessary if the top of the container 22 is positioned proximate to the second position 28 of the rotary slat 3. If no chute 25 is used, the delivery sensor 33 may be located between the second position 28 and the top of the container 22.

Each delivery sensor 33 detects the passage of pills 23 along a delivery path associated with one of the filling stations 26 and extending from the second position 28 of the corresponding rotary slat 3 to the corresponding container 22 that is being filled at that filling station 26. As shown in FIG. 3A, each delivery sensor 33 is communicatively connected with a controller 50. Together, the delivery sensor 33 for each filling station 26 and the controller 50 calculate the number of pills 23 that have been delivered to the container 22 or the number of pills 23 that still must be delivered to the container 22. For example, in one embodiment, the delivery sensor 33 sends a signal to the controller 50 each time the delivery sensor 33 detects the passage of a pill 23 along the delivery path of the corresponding filling station 26. The controller 50 counts the signals from the delivery sensor 33 and calculates the difference between the number of pills 23 that are desired to be delivered to the container 22 and the number of pills 23 that have been delivered to that container 22. Thus, the controller 50 can determine when each container 22 has received the correct number of pills 23.

The controller 50 is also in communicative contact with the drive motors of the drive assembly 41. Depending on whether the container 22 corresponding to a particular filling station 26 has received the desired number of pills 23, the controller 50 controls the driving motors to start rotating, continue rotating, or stop rotating the rotary slats 3. When the controller 50 determines that one of the containers 22 has received the desired number of pills 23, the controller 50 stops the drive motor that corresponds to the filling station 26 of the filled container 22. The drive motors corresponding to the other filling stations 26 continue to rotate the rotary slats 3 until the desired number of pills 23 have been delivered to each of the containers 22. When the desired number of pills 23 has been delivered to each of the containers 22, all of the rotary slats 3 are stopped and the conveyor 24 transports the filled containers 22 away from the filling stations 26. When the delivery sensor 33 is positioned at the top of the chute 25, a small delay may be built into the controller logic after the last pill 23 has been counted but before the conveyor 24 has been advanced to allow time for the last pill 23 to fall through the chute 25. Because the controller 50 independently controls the delivery of pills 23 to each container 22 and independently calculates the number of pills 23 delivered to each container 22, it is not important that the containers 22 are filled at uniform rates. Each container 22 receives the proper number of pills 23 even if some of the pill apertures 7 fail to receive and deliver pills 23. Further, each container 22 receives the proper number of pills 23 regardless of whether more of the pill apertures 7 of one rotary slat 3 receive and deliver pills 23 than the pill apertures 7 of the other rotary slats 3.

A number of transportation devices that are known in the art can be used to transport the containers 22 to the filling stations 26, the most common type being the conveyor 24 comprising at least one conveyor belt and at least one conveyor motor 34. Preferably, the conveyor 24 supports the containers 22 and transports them in a direction parallel to the axis of rotation of the rotary slats 3. A first stop gate 60 is positioned proximate to the conveyor 24 so that when a first stop gate actuator 61 extends the first stop gate 60, the first stop gate 60 blocks the path of the containers 22 on the conveyor 24 at the filling stations 26 and holds the containers 22 in positions corresponding to the filling stations 26. Similarly, a second stop gate 62 is extended by a second stop gate actuator 63 to block the path of the unfilled containers 22 before they have entered the filling stations 26. The first and second stop gate actuators 61, 63 are controlled by the controller 50. In a normal mode of operation, the first stop gate 60 is extended and the second stop gate 62 is retracted so that unfilled containers 22 are transported by the conveyor 24 into positions corresponding to the filling stations 26. When a number of unfilled containers 22 corresponding to the number of filling stations 26 has proceeded past the second stop gate 62, the second stop gate 62 is extended, blocking other containers 22 from proceeding to the filling stations 26. The conveyor motors 34 may stop once the containers 22 are in position, or the conveyor 24 may continue to move, sliding beneath the containers 22 held at the filling stations 26 by the stop gates 60, 62. The controller 50 starts the drive assembly 41 to begin filling the containers 22. The controller 50 may also control the speed of the drive motors of the drive assembly 41, so that, for example, each rotary slat 3 can be slowed down before the corresponding container 22 is filled to prevent overfilling. Additionally, the controller 50 can alternately accelerate and decelerate the rotary slats 3, individually or in unison, to cause a jerking or vibratory motion in the rotary slats and agitate the pills 23. Such agitation of the pills 23 can be useful in encouraging the pills 23 to become seated in the pill apertures 7. After the containers 22 at the filling stations 26 have been filled, the first stop gate 60 is retracted so that the containers are transported away from the filling stations 26 for further processing or packaging. The second stop gate 62 is again retracted and the first stop gate 60 is extended so that different, unfilled containers 22 are transported to the filling stations 26.

Alternatively, a screw auger (not shown) can be used to transport the containers 22 and position the containers 22 at the filling stations 26. The screw auger maintains the containers 22 at consecutively spaced intervals, and as the screw auger is rotated, each of the containers 22 is transported toward or away from the filling stations 26. Thus, the rotational speed of the screw auger can be adjusted to speed, slow, stop, or reverse the direction of the containers 22.

The controller 50 is also in communicative contact with the level sensor 32 and a reservoir gate switch (not shown) that controls a reservoir gate 31. The level sensor 32 detects the quantity of pills 23 in the common interior space 12 and communicates a corresponding value or signal to the controller 50. For example, the level sensor 32 can detect the quantity of pills 23 by detecting the level of pills 23 piled in the common interior space 12. When the controller 50 detects that the level of pills 23 in the common interior space 12 is below the desired level, the controller 50 signals the reservoir gate switch to open the reservoir gate 31. By opening and closing the reservoir gate 31, which controls the passage of pills 23 from the reservoir 30 to the common interior space 12 of the drum 2, the controller 50 maintains a desired number of pills 23 in the rotary slats 3 of the drum 2. The desired level of pills 23 may be adjusted to optimize the seating of pills 23 in the pill apertures 7 and to prevent wearing or breaking of the pills 23 caused by overfilling of the drum 2. Also, while the embodiment of FIG. 3 shows a single reservoir 30 on one side of the drum 2, it is also understood that multiple reservoirs 30 may be used. For example, an additional reservoir 30 may be positioned at the opposite end of the packaging apparatus 1, so that pills 23 are fed into the common interior space 12 of the drum 2 through both end plates 13*a*, 13*b*. In the case where pills 23 are fed into the common interior space 12 through both end plates 13*a*, 13*b*, the first end plate 13*a* is modified to define an aperture similar to the pill feed aperture 14 of the second end plate 13*b*.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An automated packaging apparatus for depositing a predetermined number of pills into a series of containers, comprising:

a plurality of rotary slats, wherein each of said plurality of rotary slats is independently rotatable and comprises an outer peripheral edge portion, said rotary slats are configured such that said outer peripheral edge portions together define a common interior space, each of said outer peripheral edge portions defining a plurality of pill apertures extending therethrough, and each of said pill apertures is configured to receive one of the pills from said common interior space at a first position and transmit the pill outside said rotary slats at a second position;

a conveyor configured to move a plurality of open containers along a predetermined path of travel and position each of said containers adjacent a respective rotary slat to define a delivery path extending between the second position of said rotary slat and said container;

at least one drive motor in driving engagement with said rotary slats for rotating said rotary slats; and a controller connected to said at least one drive motor for controlling said at least one drive motor such that said rotary slats can be independently rotated for different durations.

2. The automated packaging apparatus of claim 1 further comprising a shroud extending from a location proximate to said first position to a location proximate to said second position such that said shroud prevents the pills from exiting said rotary slats through said pill apertures prior to the pills reaching said second position.

3. The automated packaging apparatus of claim 1 further comprising an air blower located in said common interior space and configured to emit air towards said pill apertures at said second position.

4. The automated packaging apparatus of claim 1 further comprising a plurality of plows, each plow extending toward said pill apertures at the second position of said rotary slats such that said plows urge said pills from said pill apertures.

5. The automated packaging apparatus of claim 1 further comprising an air blower located outside said plurality of rotary slats and configured to emit air towards said pill apertures at a third position of said rotary slats such that pills positioned within said pill apertures at said third position are urged into said common interior space.

6. The automated packaging apparatus of claim 1 wherein each of said plurality of rotary slats defines an inner contour sloped toward said pill apertures to facilitate the entry of pills into said pill apertures.

7. The automated packaging apparatus of claim 1 wherein said pill apertures are slanted downward toward the outside of said rotary slats when positioned at the second position such that said pills tend to fall from said pill apertures and out of said rotary slats at the second position.

8. The automated packaging apparatus of claim 1 wherein said inner surface of each of said plurality of rotary slats defines an inner contour that varies around the circumference of the rotary slat to facilitate the entry of pills into said pill apertures.

9. The automated packaging apparatus of claim 1 wherein said rotary slats are supported by a plurality of cradle rollers.

10. The automated packaging apparatus of claim 1 further comprising a drive assembly engaged to said rotary slats for independently rotating each of said rotary slats.

11. The automated packaging apparatus of claim 10 wherein said drive assembly includes a plurality of drive wheels, each said drive wheel contoured to match said outer peripheral edge portion of said rotary slats.

12. The automated packaging apparatus of claim 1 wherein said rotary slats are positioned with gaps of between about 0.5 to 1 millimeter between adjacent rotary slats.

13. The automated packaging apparatus of claim 1 wherein said rotary slats are formed of a compound comprising acrylonitrile-butadiene-sytrene and polytetrafluoroethylene.

14. The automated packaging apparatus of claim 1 further comprising a reservoir configured to hold the pills and feed the pills into said common interior space defined by said rotary slats.

15. The automated packaging apparatus of claim 12 further comprising a reservoir gate configured to control the passage of pills from said reservoir to said common interior space.

16. The automated packaging apparatus of claim 1 further comprising a sensor configured to detect the quantity of the pills in said common interior space of said rotary slats.

17. The automated packaging apparatus of claim 1 further comprising a plurality of chutes, each of said chutes defining said delivery path extending from said second position of one of said rotary slats to the corresponding container.

18. The automated packaging apparatus of claim 1 further comprising a delivery sensor that detects the delivery of a pill through said delivery path.

19. The automated packaging apparatus of claim 1 wherein said controller is configured to alternately accelerate and decelerate said rotary slats such that said rotatory slats are vibrated and the pills are agitated.

20. An method of depositing a predetermined number of pills into a series of containers, comprising:

disposing a plurality of pills in a common interior space of a drum, the drum comprising a plurality of rotary slats;

capturing a plurality of the pills in individual pill apertures defined by an outer peripheral edge portion of the plurality of rotary slats;

independently rotating the rotary slats to a position where the pills are released from the pill apertures thereby delivering the pills to a plurality of containers;

counting each pill as the pills are delivered to the containers;

positively determining the number of pills deposited into each of the containers; and stopping the rotation of the rotary slats for which the respective containers have received a predetermined number of pills while continuing the rotation of any slats for which the respective container has not received the predetermined number of pills.

21. The method of claim 20 further comprising directing air toward the pill apertures in a direction from the common interior space of the rotary slats toward the outside of the rotary slats to facilitate the release of the pills from the pill apertures.

22. The method of claim 20 further comprising contacting the pills with a plow to urge the pills from the rotary slats.

23. The method of claim 20 further comprising directing air toward the pill apertures in a direction from the outside of the rotary slats to urge pills in the pill apertures toward the common interior space.

24. The method of claim 20 further comprising detecting the quantity of the pills in the common interior space and automatically feeding more pills into the common interior space to maintain a predetermined quantity pills in the common interior space.

25. The method of claim 20 wherein said rotating step comprises alternately accelerating and decelerating the rotary slats to agitate the pills.

26. The method of claim 20 further comprising during said rotating step preventing the release of each of the pills from the pill apertures before each of the pills reaches a predetermined release position with a shroud that partially surrounds the rotary slats.

27. The method of claim 20 further comprising supporting the rotary slats with at least two cradle rollers.

28. The method of claim 20 further wherein said rotating step comprises independently driving each of the rotary slats with at least one drive device.

29. The method of claim 20 wherein said delivering step comprises dropping the pills through chutes, the chutes guiding the pills toward the containers.

* * * * *